US007778580B2

(12) United States Patent
Amico et al.

(10) Patent No.: US 7,778,580 B2
(45) Date of Patent: Aug. 17, 2010

(54) LIQUID DELIVERY SYSTEMS, FUSER ASSEMBLIES, PRINTING APPARATUSES AND METHODS OF DELIVERING RELEASE AGENTS TO FUSING IMAGING SURFACES

(75) Inventors: Mark Steven Amico, Pittsford, NY (US); Martin Franklin Zess, Churchville, NY (US)

(73) Assignee: Xerox Corporation, Norwalk, CT (US)

( * ) Notice: Subject to any disclaimer, the term of this patent is extended or adjusted under 35 U.S.C. 154(b) by 119 days.

(21) Appl. No.: 12/183,560

(22) Filed: Jul. 31, 2008

(65) Prior Publication Data

US 2010/0028060 A1 Feb. 4, 2010

(51) Int. Cl.
*G03G 15/20* (2006.01)

(52) U.S. Cl. ..... 399/325

(58) Field of Classification Search ..... 399/324, 399/325, 326

See application file for complete search history.

(56) References Cited

U.S. PATENT DOCUMENTS 4,426,953 A 1/1984 Kromm, Jr. et al.
6,782,233 B2 8/2004 Condello et al.
7,054,588 B2 * 5/2006 Wu et al. ..... 399/325
2004/0101333 A1 5/2004 Wu et al.

OTHER PUBLICATIONS

U.S. Appl. No. 12/034,197, filed Feb. 20, 2008.
European Search Report Dated Dec. 9, 2009, issued in related EP Application No. 09165484.8.

* cited by examiner

*Primary Examiner*—Hoang Ngo
(74) *Attorney, Agent, or Firm*—Edward A. Brown; Prass LLP

(57) ABSTRACT

Liquid delivery systems, fuser assemblies, printing apparatuses and methods of delivering release agents to fusing imaging surfaces are disclosed. An embodiment of the liquid supply systems for delivering a liquid to a fusing imaging surface of a fusing member includes a first roll having a first outer surface adapted to contact a liquid contained in a sump; a first shim adapted to contact the first outer surface and the liquid in the sump; a second roll having a second outer surface adapted to contact the liquid in the sump, the first and second rolls contacting each other at an interface; and a second shim adapted to contact the second outer surface and the liquid in the sump. At least one of the first outer surface and the second outer surface is comprised of a compressible material which is compressed along the interface. The first and second shims define a liquid passage through which the liquid is metered from the sump to the interface, and the first and second rolls are rotatable to meter the liquid through the interface to the fusing imaging surface of the fusing member.

20 Claims, 3 Drawing Sheets

LIQUID DELIVERY SYSTEMS, FUSER ASSEMBLIES, PRINTING APPARATUSES AND METHODS OF DELIVERING RELEASE AGENTS TO FUSING IMAGING SURFACES

BACKGROUND

Liquid delivery systems, fuser assemblies, printing apparatuses and methods of delivering release agents to fusing imaging surfaces are disclosed.

In printing apparatuses, liquids can be supplied to fusing members by liquid delivery systems. Such liquids include release agents used for reducing adherence of media and toner to the fusing members. It would be desirable to provide liquid delivery systems that can supply such liquids to fusing members in a more desirable manner.

SUMMARY

According to aspects of the embodiments, liquid delivery systems, fuser assemblies, printing apparatuses and methods of delivering liquids to fusing imaging surfaces are disclosed.

An exemplary embodiment of the liquid delivery system for delivering a liquid to a fusing imaging surface of a fusing member is provided, which includes a first roll having a first outer surface adapted to contact a liquid contained in a sump; a first shim adapted to contact the first outer surface and the liquid in the sump; a second roll having a second outer surface adapted to contact the liquid in the sump, the first and second rolls contacting each other at an interface; and a second shim adapted to contact the second outer surface and the liquid in the sump. At least one of the first outer surface and the second outer surface is comprised of a compressible material which is compressed along the interface. The first and second shims define a liquid passage through which the liquid is metered from the sump to the interface, and the first and second rolls are rotatable to meter the liquid through the interface to the fusing imaging surface of the fusing member.

DRAWINGS

DETAILED DESCRIPTION

The disclosed embodiments include a liquid delivery system for delivering a liquid to a fusing imaging surface of a fusing member, which comprises a first roll having a first outer surface adapted to contact a liquid contained in a sump; a first shim adapted to contact the first outer surface and the liquid in the sump; a second roll having a second outer surface adapted to contact the liquid in the sump, the first and second rolls contacting each other at an interface; and a second shim adapted to contact the second outer surface and the liquid in the sump. At least one of the first outer surface and the second outer surface is comprised of a compressible material which is compressed along the interface. The first and second shims define a liquid passage through which the liquid is metered from the sump to the interface, and the first and second rolls are rotatable to meter the liquid through the interface to the fusing imaging surface of the fusing member.

The disclosed embodiments further include a fuser assembly, which comprises a first roll comprised of a compressible material having a first outer surface adapted to contact a liquid contained in a sump; a first shim adapted to contact the first outer surface and the liquid in the sump; a second roll comprised of a compressible material having a second outer surface adapted to contact the liquid in the sump, the first and second rolls contacting each other along an interface at which the first and second outer surfaces are compressed against each other; a second shim adapted to contact the second outer surface and the liquid in the sump; and a fusing member having a fusing imaging surface; a pressure roll having an outer surface facing the fusing imaging surface to form a nip. The first and second shims define a liquid passage through which the liquid is metered from the sump to the interface, and the first and second rolls are rotatable to meter the liquid through the interface to the fusing imaging surface of the fusing member.

The disclosed embodiments further include a method of delivering a release agent to a fusing imaging surface of a fusing member, which comprises metering the release agent from a sump to an interface along which a first outer surface of a first roll and a second outer surface of a second roll are in contact with each other at an interface which is compressed along the interface, at least one of the first outer surface and the second outer surface being comprised of a compressible material; and metering the release agent through the interface to the fusing imaging surface of the fusing member.

Figure 1:
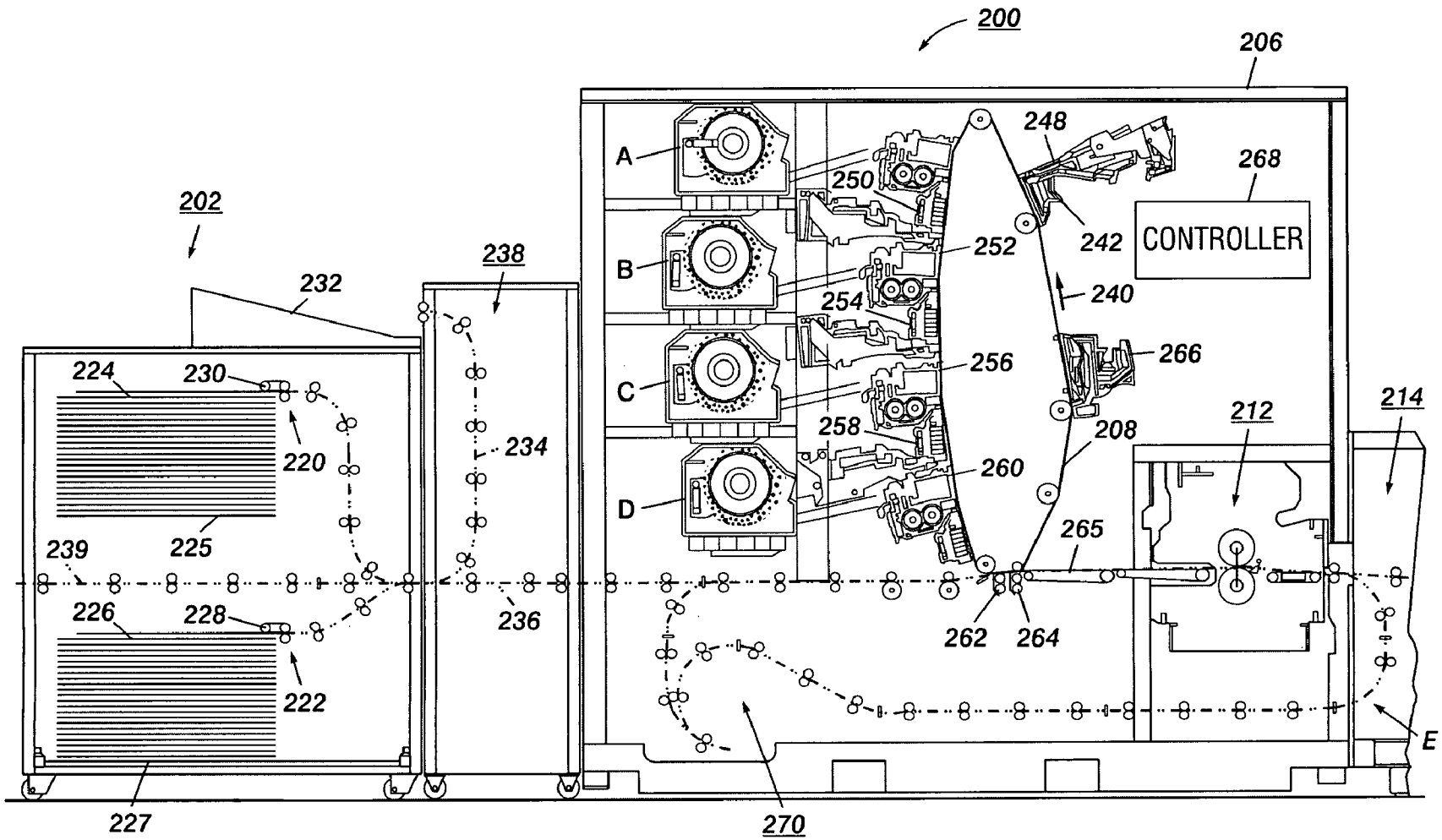
FIG. 1 illustrates an exemplary embodiment of a printing apparatus.

FIG. 1 illustrates an exemplary printing apparatus 200, such as disclosed in U.S. patent application Ser. No. 12/034,197, which is incorporated herein by reference in its entirety. As used herein, the term "printing apparatus" encompasses any apparatus, such as a digital copier, bookmaking machine, multifunction machine, and the like, that performs a print outputting function for any purpose. The printing apparatus 200 can be used to produce prints on various media, such as coated or uncoated (plain) paper sheets. The media can have various sizes, weights and be plain or coated.

In embodiments, the printing apparatus 200 has a modular construction. The printing apparatus 200 includes a printer module 206 containing a photoreceptor belt 208. During operation, the photoreceptor belt 208 is advanced by a drive mechanism in the direction of arrow 240 through various processing stations positioned around the path of photoreceptor belt 208. A charger 242 is operable to charge an area of photoreceptor belt 208 to a relatively high, substantially uniform potential. Then, the charged area of the photoreceptor belt 208 passes a light-emitting device 248, such as a laser array, which exposes selected areas of photoreceptor belt 208 to a pattern of light, so as to discharge these selected areas to produce an electrostatic latent image. Then, the light-exposed areas of the photoreceptor belt 208 pass a developer unit A, which deposits a toner layer on charged areas of the photoreceptor belt 208.

Then, a charger 250 charges an area of photoreceptor belt 208 to a relatively high, substantially uniform potential. Then, the charged area of photoreceptor belt 208 passes a light-emitting device 252 to expose selected areas of photoreceptor belt 208 to a pattern of light, so as to discharge these selected areas to produce an electrostatic latent image. Then, the light-exposed areas of the photoreceptor belt 208 pass a developer unit B, which deposits a toner layer on charged areas of the photoreceptor belt 208.

Then, a charger 254 charges an area of photoreceptor belt 208 to a relatively high, substantially uniform potential. Then, the charged area of photoreceptor belt 208 passes a light-emitting device 256, which exposes selected areas of photoreceptor belt 208 to a pattern of light, so as to discharge these selected areas to produce an electrostatic latent image. Then, the light-exposed areas of the photoreceptor belt 208 pass a developer unit C, which deposits a toner layer on charged areas of the photoreceptor belt 208.

Then, a charger 258 charges the area of the photoreceptor belt 208 to a relatively high, substantially uniform potential. Then, the charged area of photoreceptor belt 208 passes a light-emitting device 260, which exposes selected areas of photoreceptor belt 208 to a pattern of light, so as to discharge these selected areas to produce an electrostatic latent image. Then, the light-exposed areas of the photoreceptor belt 208 pass a developer unit D, which deposits a toner layer on charged areas of the photoreceptor belt 208.

This processing produces a full-color toner image on the photoreceptor belt 208. A registration system receives media from a media feeder module 202 via an interface module 238 and brings the media into contact with the toner image on the photoreceptor belt 208. In embodiments, media feeder module 202 includes high-capacity feeders 220, 222, which feed media in the form of sheets from media stacks 224, 226, positioned on media supply trays 225, 227, respectively, into the interface module 238, which directs the sheets either to a purge tray 232 via a media feed path 234, or to the printer module 206 via a media feed path 236. Additional high-capacity media trays can optionally be incorporated into the apparatus 200 to feed sheets along media path 239.

A corotron 262 charges a sheet to tack the sheet to photoreceptor belt 208 and transfer the toner image from photoreceptor belt 208 to the sheet. Then, a de-tack corotron 264 charges the sheet to an opposite polarity to de-tack the sheet from the photoreceptor belt 208. A pre-fuser transport 265 moves the sheet to a fuser 212, which applies heat and pressure to the sheet to permanently affix the toner to the sheet. The sheet is then advanced to a stacker module 214, or to a duplex loop E.

A cleaning device 266 is adapted to remove toner remaining on the image area of photoreceptor belt 208. In order to complete duplex copying, duplex loop E feeds sheets back for transfer of a toner image to the opposite sides of the respective sheets. A duplex inverter 270, in duplex loop E, inverts sheets such that the face of the sheet that was the top face on the previous pass through transfer will be the bottom face on the sheet, on the next pass through transfer. The duplex inverter 270 inverts each sheet such that what was the leading edge of the sheet, on the previous pass through transfer, will be the trailing on the sheet, on the next pass through transfer.

Figure 2:
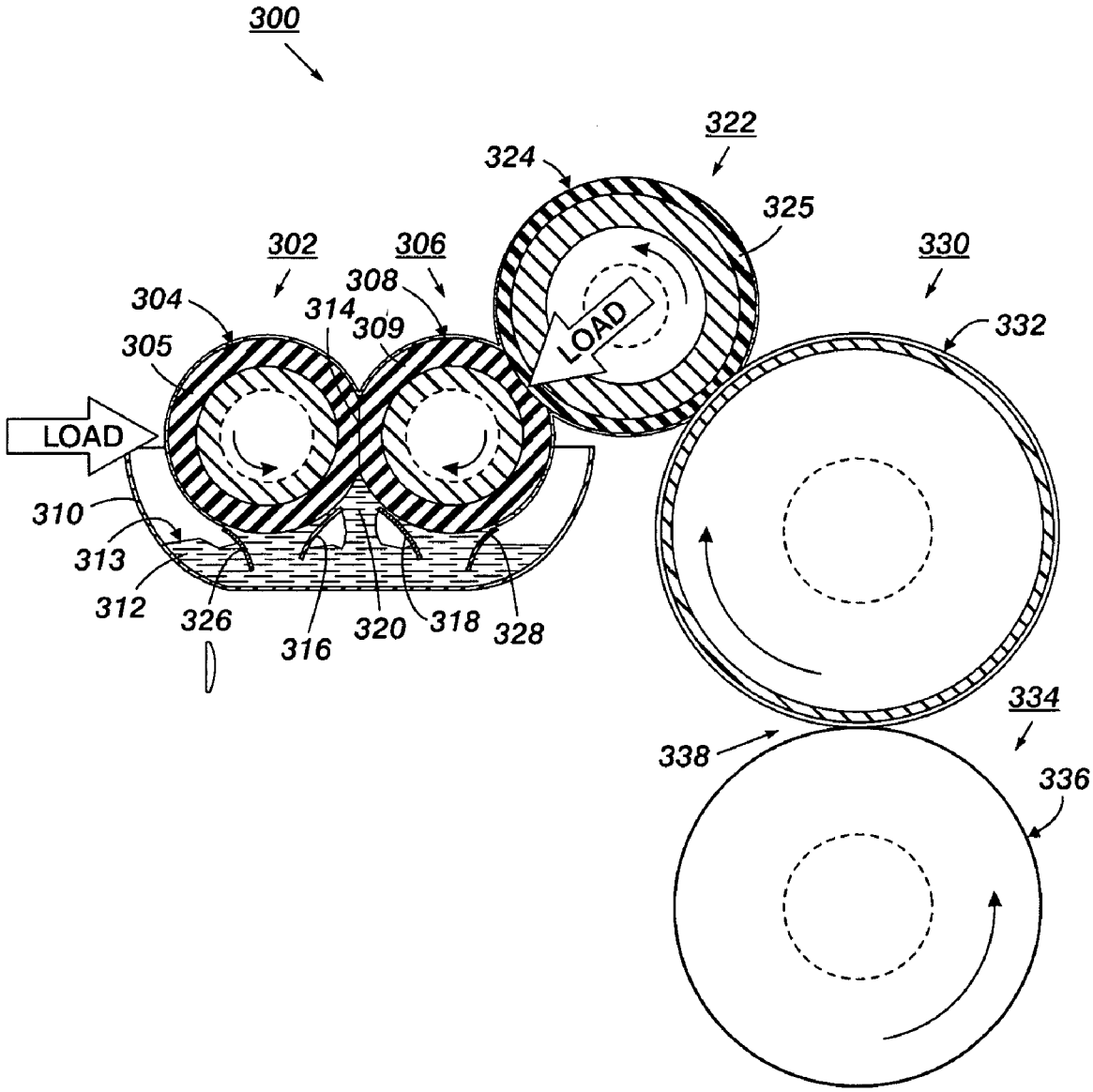
FIG. 2 illustrates an exemplary embodiment of a printing apparatus including a liquid delivery system for delivering a liquid to a fusing imaging surface of a fuser roll of a fuser assembly.

FIG. 2 illustrates an embodiment of a printing apparatus including a liquid delivery system 300 according to an exemplary embodiment. The liquid delivery system 300 is adapted to deliver liquid to a fusing imaging surface of a fusing member. The liquid delivery system 300 can be used in different printing apparatuses, such as in the printing apparatus 200 shown in FIG. 1. For example, the liquid delivery system 300 can be used in the printing apparatus 200 to deliver liquid to the fuser 212. In embodiments, the liquid is a release agent effective to reduce adherence of media and toner to the fusing imaging surface of the fusing member.

In embodiments, the liquid delivery system 300 includes a first roll 302 having an outer surface 304 and a second roll 306 having an outer surface 308. In the illustrated exemplary embodiment, each of the first outer surface 304 and the second outer surface 308 is comprised of a compressible (elastically deformable) material. In another exemplary embodiment, the first outer surface 304 of the first roll 302 is made of a non-compressible material, while the second outer surface 308 of the second roll 306 is made of a compressible material. In another exemplary embodiment, the first outer surface 304 is made of a compressible material, while the second outer surface 308 is made of a non-compressible material. As used herein, the term "non-compressible" means that the outer surface of the associated roll maintains its normal, non-deformed shape when brought into contact with the outer surface of the other roll. For example, the non-compressible outer surface is sufficiently hard and rigid to maintain its cross-sectional shape (in the axial direction of the roll) when brought into contact with the deformable surface. The first outer surface 304 and second outer surface 308 typically have a circular, non-deformed cross-sectional shape.

In embodiments, the non-compressible material can be, e.g., a metal, such as aluminum or steel, while the compressible material can be, e.g., an elastomeric material. Exemplary compressible materials that can be used include silicone, a fluoroelastomer sold under the trademark Viton® by DuPont Performance Elastomers, L.L.C., and like polymers.

In embodiments, the first roll 302 and/or the second roll 306 can be a solid roll made of the compressible material. In the embodiment shown in FIG. 2, the first roll 302 comprises an outer layer including the first outer surface 304 overlying an elastic inner layer 305, and the second roll 306 comprises an outer layer including the second outer surface 308 overlying an elastic inner layer 309. In other embodiments, the inner layer can be a non-compressible material, such as a metal, and the outer layer can be comprised, e.g., of an elastomeric material.

In other embodiments, the first roll 302 and/or the second roll 306 can comprise a deformable, fluid-filled bladder. In such embodiments, the bladder is comprised of an elastomeric material forming the first outer surface 304 and/or the second outer surface 308. The fluid contained in the bladders can be a liquid or a gas. In such embodiments, the fluid pressure inside of the first roll 302 and/or second roll 306 is sufficiently-high to maintain the desired shape and provide the desired function of these rolls during operation of the liquid delivery system 300.

As shown, in the embodiment, the first roll 302 and second roll 306 are positioned such that the first outer surface 304 contacts the second outer surface 308 along an interface 314. In the embodiment, the first outer surface 304 and second outer surface 308 are compressed against each other (elastically deformed) at the interface 314. The area of the interface 314 can be varied by increasing or decreasing the amount of contact between the first surface 304 and second surface 308.

In an exemplary embodiment, the first roll 302 is movable in horizontal and/or vertical directions, while the second roll 306 is fixed (is not movable in horizontal and/or vertical directions). In the embodiment, a compressive load can be applied to at least one of the first roll 302 and second roll 306 to compress the first outer surface 304 and second outer surface 308 against each other at the interface 314, as the first roll 302 and second roll 306 are being rotated, as depicted. In the embodiment, a compressive load is applied to the first outer surface 304 by a load applying member, such as a spring-biased member. The magnitude of the load applied to the first outer surface 304 by the load applying member is adjustable. For example, the spring force exerted by a spring-biased member to the first outer surface 304 can be adjusted.

In the embodiment, the first roll 302 and second roll 306 have their non-deformed, round cross-sectional shapes, when a compressive load is not being applied to the first outer surface 304 or the second outer surface 308, such as when the first roll 302 and second roll 306 are not being rotated to deliver liquid to the fusing imaging surface 332.

As shown, the liquid delivery system 300 includes a sump 310 for containing a supply of a liquid 312. In embodiments, the liquid 312 is a release agent, which is applied to the fusing imaging surface of a fusing member to reduce the adherence of media, such as paper, and toner particles to the fusing imaging surface during the fusing process. The first outer surface 304 and second outer surface 308 contact the liquid 312 contained in the sump 310. In embodiments, the first roll 302 and second roll 306 can be partially immersed in the liquid 312, as shown.

As shown, embodiments of the liquid delivery system 300 can optionally include a donor roll 322 located between the second roll 306 and the fuser roll 330. The donor roll 322 includes an outer surface 324 overlying a layer 325 and contacting the second outer surface 308 of the second roll 306, and also contacting the fusing imaging surface 332 of the fuser roll 330. The outer surface 324 can be made of compressible material, or a non-compressible material. In embodiments, the donor roll 322 is movable in vertical and horizontal directions by a mechanism to vary the load applied by the outer surface 324 to the second outer surface 308.

The use of the donor roll 322 in the printing apparatus is dependent on the architecture of the printing apparatus and liquid delivery system 300. A donor roll can be included in embodiments in which the liquid delivery system is configured, and can be positioned in the printing apparatus, to avoid interfering with the feeding of media to the nip 338 via the media feed path of the printing apparatus, such as in the embodiment of the liquid delivery system 300 shown in FIG. 2.

The donor roll 322 is rotatable to convey the liquid from the second outer surface 308 to the fusing imaging surface 332. The donor roll 322 reduces the metering rate of the liquid to the fusing imaging surface 332 as compared to embodiments of the liquid delivery system in which the second outer surface 308 directly contacts the fusing imaging system 332. For example, the donor roll 322 can typically reduce the metering rate of the liquid from the second roll 306 by about one-half. In embodiments that include a donor roll 322, the metering rate from the second roll 306 to the donor roll 322 can be increased to compensate for the reduction in the metering rate resulting from incorporating the donor roll 322 into the system, in order to provide the desired liquid metering rate to the fusing imaging surface 332.

In embodiments, a first shim 316 is positioned in contact with the first outer surface 304 and the liquid 312 in the sump 310, and a second shim 318 is positioned in contact with the second outer surface 308 and the liquid 312 in the sump 310. The first shim 316 and second shim 318 are spaced from each other to define a liquid passage 320 through which the liquid 312 is supplied from the sump 310 to the interface 314. In embodiments, the first shim 316 and second shim 318 are adapted to apply sufficient pressure to the first outer surface 304 and second outer surface 308, respectively, to reduce air ingestion caused by rotation of the first roll 302 and second roll 306. Consequently, desirable contact between the liquid 312 and the first outer surface 304 and second outer surface 308 is produced, and the liquid can be supplied to the fusing imaging surface 332 substantially without air. The first shim 316 and second shim 318 are configured to direct the liquid 312 into the liquid passage 320.

The first shim 316 and the second shim 318 extend along the axial direction (i.e., length dimension) of the first roll 302 and the second roll 306. The liquid passage 320 has a length extending along the length dimension of the first roll 302 and the second roll 306. Typically, the length of the liquid passage 320 is approximately equal to the length of the first roll 302 and the second roll 306. The liquid passage 320 has a width dimension (i.e., a dimension perpendicular to the length dimension of the liquid passage 320) sized to allow metering of the liquid 312 through the liquid passage 320 to the interface 314 at a desired metering rate as the first roll 302 and second roll 306 are rotated about their respective axes in opposite directions, as indicated in FIG. 2. The first roll 302 and second roll 306 can be driven by a drive mechanism including a motor. Typically, the liquid passage 320 has a width of about 0.25 in. to about 0.5 in.

The liquid 312 in the sump 310 adheres relatively weakly to the bottom portion of each of the first roll 302 and the second roll 306. As the first roll 302 and the second roll 306 rotate, the liquid 312 moves through the liquid passage 320 and into the space located between the first roll 302 and the second roll 306 between the liquid passage 320 and the lower end of the interface 314. The amount of pressure exerted by the first shim 316 to the first roll 302 and by the second shim 318 to the second roll 306, can be adjusted to meter the liquid 312 such that only a controlled amount of the liquid 312 is allowed to move into the second stage of the metering, which occurs at the interface 314 between the first roll 302 and second roll 306.

In embodiments, a third shim 326 contacts the first outer surface 304 of the first roll 302 and the liquid 312, and a fourth shim 328 contacts the second outer surface 308 of the second roll 306 and the liquid 312. The third shim 326 is adapted to clean the first outer surface 304 and the fourth shim 328 is adapted to clean the second outer surface 308 by removing residual liquid and contamination.

In embodiments, the first shim 316, second shim 318, third shim 326 and the fourth shim 328 can be comprised of metallic or polymeric materials, for example.

The first roll 302 and second roll 306 are rotatable to meter the liquid 312 through the interface 314 to a fusing imaging surface 332 of a fusing member, which is a fuser roll 330. The fuser roll 330 is located adjacent a pressure roll 334 having an outer surface 336. The fusing imaging surface 332 and outer surface 336 define a nip 338. During operation of the printing apparatus, a medium having a face carrying at least one toner image is fed to the nip 338 where the fuser roll 330 and pressure roll 334 apply heat and pressure to the medium to fuse the toner image.

Hydraulic plane occurs when liquid accumulates in front of one or both of a pair of adjacent rolls faster than a force applied between the rolls can push the liquid out of the way. The pressure of the liquid causes the rolls to separate, thereby allowing a thin layer of the liquid to pass between the rolls. The thickness of the liquid layer is proportional to the load between the rolls. Factors that can affect hydraulic plane include the rotational speed of the rolls (as rotational speed increases, wet traction is reduced), roll surface roughness, and liquid viscosity.

In embodiments, the liquid delivery system 300 is constructed to control the occurrence of hydraulic plane in delivering the liquid 312 to the fusing imaging surface 332, allowing controlled metering of the liquid 312. The liquid delivery system 300 is adapted to control the metering rate of the liquid into the interface 314, and also through the interface 314 to the fusing imaging surface 332 of the fuser roll 330. The liquid metering rate can be controlled by, e.g., varying the load applied to the first outer surface 304 and/or the second outer surface 308 by the load applying member(s); varying the rotational speed of the first roll 302 and second roll 306; and/or varying the viscosity of the liquid 312. For a given liquid 312 composition, increasing the load applied to the first outer surface 304 and/or the second outer surface 308 by the load applying member and/or the donor roll 322 reduces the metering rate of the liquid 312 to the fusing imaging surface 332. For a given liquid 312 composition and applied load, decreasing the rotational speed of the first roll 302 and second roll 306 reduces the metering rate. For a given load applied to the first outer surface 304 and/or the second outer surface 308 by the load applying member and/or donor roll 322 and a given rotational speed of the first roll 302 and second roll 306, increasing the viscosity of the liquid 312 reduces the metering rate of the liquid to the fusing imaging surface 332. Decreasing the viscosity of the liquid 312 decreases the load that can be applied to the first roll 302 and/or second roll 306 to achieve a given metering rate of the liquid 312. In embodiments, the first outer surface 304 and the second outer surface 308 can be smooth to provide smooth liquid layers.

In embodiments, it is desirable to control metering of the release agent to a fusing imaging surface of a fuser member (e.g., a fuser roll or fusing belt) using embodiments of the liquid supply system, such as the liquid supply system 300, to place about 2 μl to about 15 μl of release oil on one side of media fed to the nip 338 by liquid transfer. The liquid supply system 300 can typically deliver liquid from the interface 314 to the fusing imaging surface 332 within several seconds, or less. By providing consistent and accurate control of the metering rate of liquid supplied to fusing imaging surfaces of fusing members, embodiments of the liquid supply system 300 can be used to vary the amount of release agent placed on media, and also to vary the location on faces of the media at which the release agent is placed. This control of release agent placement can be provided by, e.g., varying the rotational speed of the first roll 302, second roll 306 and optional donor roll 322, or by varying the compressive load applied to the first roll 302 and/or second roll 306. For example, in embodiments, a greater amount of release agent can be placed at the leading edge of media than at other portions of such media. In embodiments, a greater amount of release agent can be placed on different media in a print job, or on media in different print jobs. The amount of the release agent placed on media can be varied depending on the media image content. For example, a smaller amount of release agent can be placed on media that carry text-based images, while a larger amount of release agent can be placed on media, such as posters, that carry other types of images.

In embodiments, the liquid delivery system 300 is constructed such that after the liquid 312 has been delivered to an adjacent roll for final depositing onto the fusing imaging surface 332, the liquid is returned to a secondary sump (not shown) for treatment, such as filtration, to complete the liquid delivery cycle.

Figure 3:
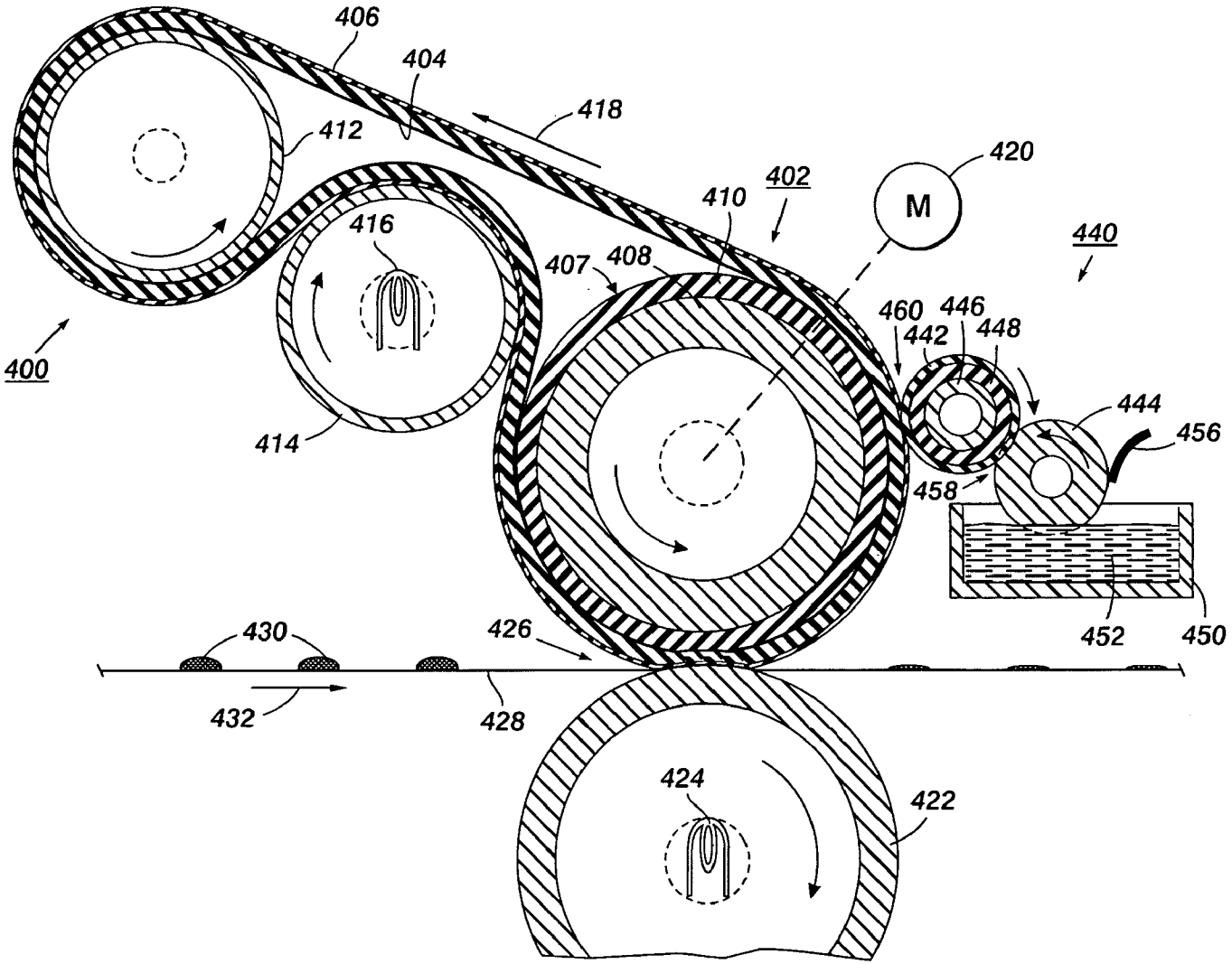
FIG. 3 illustrates an exemplary embodiment of a printing apparatus including a fuser assembly with a fusing belt and a liquid delivery system.

Embodiments of the liquid delivery system also can be used in fuser assemblies that include a fusing belt having a fusing imaging surface to deliver controlled amounts of liquids to media that are subjected to fusing in such fuser assemblies. In such embodiments, the liquid delivery system is constructed to supply liquids, such as release agents, to the fusing imaging surface of such fusing belts. FIG. 3 illustrates a portion of a printing apparatus including an embodiment of a fuser assembly 400, such as disclosed in U.S. Pat. No. 6,782,233, which is incorporated herein by reference in its entirety. The fuser assembly 400 includes a fusing belt 402 supported on an upper pressure roll 407 having a base layer 408 and an outer layer 410, and on a roll 412. A motor 420 drives the upper pressure roll 407 in the counter-clockwise direction, as shown. The fusing belt 402 includes an outer layer having an outer surface 406, and an inner layer having an inner surface 404. A roll 414 with an internal heater 416 is arranged in contact with the outer surface 406 of the fusing belt 402. As indicated, the fusing belt 402 is driven in the direction of arrow 418.

The fuser assembly 400 further includes a lower pressure roll 422 with an internal heater 424. The upper pressure roll 407 and the lower pressure roll 422 define a nip 426. As shown, a medium 428, such as plain or coated paper, having toner images 430 on a top face, is fed to the nip 426. At the nip 426, the upper pressure roll 407 and lower pressure roll 422 apply heat and pressure to fuse the toner images 430 on the medium 428.

As shown, the printing apparatus includes a release agent management (RAM) system 440 positioned adjacent the fusing belt 402. The RAM system 440 includes a donor roll 442 and a metering roll 444. The donor roll 442 and the fusing belt 402 define a nip 460. The donor roll 442 includes an inner layer 446 and an outer layer 448. The donor roll 442 and a metering roll 444 define a nip 458. The metering roll 444 is partially immersed in a supply of a liquid release agent 452 contained in a sump 450. The donor roll 442 and a metering roll 444 rotate in opposite directions, as shown, to convey the release agent 452 from the donor roll 442 to the outer surface 406 of the fusing belt 402 at the nip 460. A doctor blade 456 is positioned in contact with the metering roll 444 to meter the supply of the release agent to the donor roll 442.

Embodiments of the liquid delivery system, such as the liquid delivery system 300, can be incorporated into the printing apparatus 400 in place of the RAM system 440. In such embodiments, the liquid delivery system 300 can be arranged in the printing apparatus 400 at the location of the RAM system 440 such that the first roll 302 contacts the outer surface 406 of the fusing belt 402.

In other embodiments, the liquid delivery system 300 can be arranged at a location in the printing apparatus 400 such that the second roll 306 contacts the outer surface 406 of the fusing belt 402. In some embodiments, the liquid delivery system 300 used in the printing apparatus 400 can include a donor roll, such as the donor roll 322, located between the second roll 306 and the fusing belt 402 for conveying liquid to the outer surface 406.

It will be appreciated that various ones of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A liquid delivery system for delivering a liquid to a fusing imaging surface of a fusing member, comprising:

a first roll having a first outer surface adapted to contact a liquid contained in a sump;

a first shim adapted to contact the first outer surface and the liquid in the sump;

a second roll having a second outer surface adapted to contact the liquid in the sump, the first and second rolls contacting each other at an interface; and a second shim adapted to contact the second outer surface and the liquid in the sump;

wherein at least one of the first outer surface and second outer surface is comprised of a compressible material which is compressed along the interface;

wherein the first and second shims define a liquid passage through which the liquid is metered from the sump to the interface, and the first and second rolls are rotatable to meter the liquid through the interface to the fusing imaging surface of the fusing member.

2. The liquid delivery system of claim 1, further comprising:

the sump containing a supply of the liquid, the first and second rolls and the first and second shims contacting the liquid contained in the sump;

a third shim adapted to contact and clean the first outer surface; and a fourth shim adapted to contact and clean the second outer surface.

3. The liquid delivery system of claim 1, wherein each of the first and second outer surfaces is comprised of a compressible elastomeric material.

4. The liquid delivery system of claim 1, further comprising a load applying member adapted to apply a compressive load to the first outer surface, wherein the compressive load is adjustable to vary an amount of pressure exerted between the first and second outer surfaces at the interface.

5. The liquid delivery system of claim 1, further comprising a donor roll located between the second roll and the fusing member, the donor roll including an outer surface which contacts the second outer surface and is adapted to contact the fusing imaging surface, the donor roll being rotatable to convey the liquid from the second outer surface to the fusing imaging surface.

6. A printing apparatus, comprising:

a liquid delivery system according to claim 5; and the fusing member including the fusing imaging surface;

wherein the outer surface of the donor roll contacts the fusing imaging surface.

7. A printing apparatus, comprising:

a liquid delivery system according to claim 1; and the fusing member including the fusing imaging surface;

wherein the second outer surface contacts the fusing imaging surface.

8. A fuser assembly, comprising:

a first roll comprised of a compressible material having a first outer surface adapted to contact a liquid contained in a sump;

a first shim adapted to contact the first outer surface and the liquid in the sump;

a second roll comprised of a compressible material having a second outer surface adapted to contact the liquid in the sump, the first and second rolls contacting each other along an interface at which the first and second outer surfaces are compressed against each other;

a second shim adapted to contact the second outer surface and the liquid in the sump;

a fusing member having a fusing imaging surface; and a pressure roll having an outer surface facing the fusing imaging surface to form a nip;

wherein the first and second shims define a liquid passage through which the liquid is metered from the sump to the interface, and the first and second rolls are rotatable to meter the liquid through the interface to the fusing imaging surface of the fusing member.

9. The fuser assembly of claim 8, further comprising:

the sump containing a supply of the liquid;

a third shim adapted to contact the first outer surface and the liquid and to clean the first outer surface; and a fourth shim adapted to contact the second outer surface and the liquid and to clean the second outer surface.

10. The fuser assembly of claim 8, further comprising a donor roll located between the second roll and the fusing member, the donor roll including an outer surface which contacts the second outer surface and the fusing imaging surface, the donor roll being rotatable to convey the liquid from the outer surface to the fusing imaging surface.

11. The fuser assembly of claim 8, further comprising a load applying member adapted to apply a compressive load to the first outer surface, wherein the compressive load is adjustable to vary an amount of pressure exerted between the first and second outer surfaces at the interface.

12. The fuser assembly of claim 8, wherein the fusing member is a fuser roll including the fusing imaging surface.

13. The liquid delivery system of claim 8, wherein the fusing member is a fusing belt including the fusing imaging surface.

14. A method of delivering a release agent to a fusing imaging surface of a fusing member with a liquid delivery system, the liquid delivery system comprising a first roll having a first outer surface contacting a liquid contained in a sump, a first shim contacting the first outer surface and the liquid in the sump, a second roll having a second outer surface contacting the liquid in the sump, the first outer surface and the second outer surface contacting each other at an interface, and a second shim contacting the second outer surface and the liquid in the SUMP, the first shim and second shim defining a liquid passage, and at least one of the first outer surface and second outer surface being comprised of a compressible material which is compressed along the interface, the method comprising:

metering the release agent from the sump to the interface through the liquid passage; and metering the release agent through the interface to the fusing imaging surface of the fusing member by rotating the first roll and second roll.

15. The method of claim 14, wherein the metering of the release agent from the sump to the interface through the liquid passage comprises:

rotating the first and second rolls;

applying pressure against the first outer surface with the first shim in contact with the release agent in the sump; and applying pressure against the second outer surface with the second shim in contact with the release agent in the sump;

wherein the release agent is metered from the sump to the interface through the liquid passage as the first and second rolls are rotated.

16. The method of claim 14, wherein the metering of the release agent through the interface to the fusing imaging surface of the fusing member comprises:

conveying the release agent from the second outer surface to an outer surface of a donor roll located between the second roll and the fusing member, the outer surface contacting the second outer surface and the fusing imaging surface; and conveying the release agent from the outer surface of the donor roll to the fusing imaging surface.

17. The method of claim 14, wherein the metering of the release agent through the interface to the fusing imaging surface of the fusing member comprises:

rotating the first and second rolls in opposite directions; and simultaneously applying a compressive load to at least one of the first and second outer surfaces to compress at least one of the first and second outer surfaces against the other of the first and second outer surfaces at the interface.

18. The method of claim 17, further comprising adjusting at least one of (i), (ii) and (iii) to control a rate of metering the release agent from the sump to the interface and a rate of metering the release agent through the interface to the fusing imaging surface of the fusing member:

(i) the magnitude of the compressive load to vary an amount of pressure exerted between the first and second outer surfaces at the interface;

(ii) the viscosity of the release agent; and (iii) a rotational speed of the first and second rolls.

19. The method of claim 14, further comprising:

feeding a first medium carrying a toner image to a nip defined between the fusing imaging surface and an outer surface of a pressure roll;

transferring a first amount of the release agent from the fusing imaging surface to the first medium; and applying heat and pressure to the first medium with the fusing imaging surface and the outer surface of the pressure roll to fuse the toner image on the first medium.

20. The method of claim 19, further comprising:

feeding a second medium to the nip;

transferring a second amount of the release agent different from the first amount from the fusing imaging surface to the second medium; and applying heat and pressure to the second medium with the fusing imaging surface and the outer surface of the pressure roll to fuse the toner image on the second medium.

* * * * *